United States Patent [19]

Julich et al.

[11] 4,404,993

[45] Sep. 20, 1983

[54] CLUTCH ARRANGEMENT FOR CONTROLLING A HEDDLE OF A WEAVING MACHINE

[75] Inventors: Werner Julich, Wallisellen; Gunter Müller, Wiesendangen, both of Switzerland

[73] Assignee: Sulzer Brothers Limited, Winterthur, Switzerland

[21] Appl. No.: 312,151

[22] Filed: Oct. 16, 1981

[51] Int. Cl.³ ..... D03C 1/00

[52] U.S. Cl. ..... 139/66 R; 139/76; 192/28

[58] Field of Search ..... 139/76, 66 R; 192/28, 192/33, 71; 66/207

[56] References Cited

U.S. PATENT DOCUMENTS 4,315,530 2/1982 Brock et al. ..... 139/76

FOREIGN PATENT DOCUMENTS

| | | | |
|---|---|---|---|
| 47791 | 3/1982 | European Pat. Off. | 139/76 |
| 1154048 | 9/1963 | Fed. Rep. of Germany | 139/66 R |
| 2741199 | 2/1979 | Fed. Rep. of Germany | 139/76 |
| 2942573 | 3/1981 | Fed. Rep. of Germany | 139/76 |
| 578506 | 11/1977 | U.S.S.R. | 192/28 |
| 632772 | 11/1978 | U.S.S.R. | 139/66 R |

*Primary Examiner*—James Kee Chi

*Attorney, Agent, or Firm*—Kenyon & Kenyon

[57] ABSTRACT

The link disposed about the eccentric carries two stop elements in the form of rollers. When the pawl is engaged with the driving shaft, the stop rollers move in respective oval paths so as to engage and swing out the control levers to insure that the control levers do not accidentally swing inwardly into the path of the moving pawl or latch locking the pawl in coupled relation with the shaft. The stop rollers also permit an overstroke of the bar to occur in which there is a clearance between the bar and the reversing position of the stroke meter. In this way, the stroke of the stroke meter can be made smaller.

5 Claims, 2 Drawing Figures

CLUTCH ARRANGEMENT FOR CONTROLLING A HEDDLE OF A WEAVING MACHINE

Figure 1:
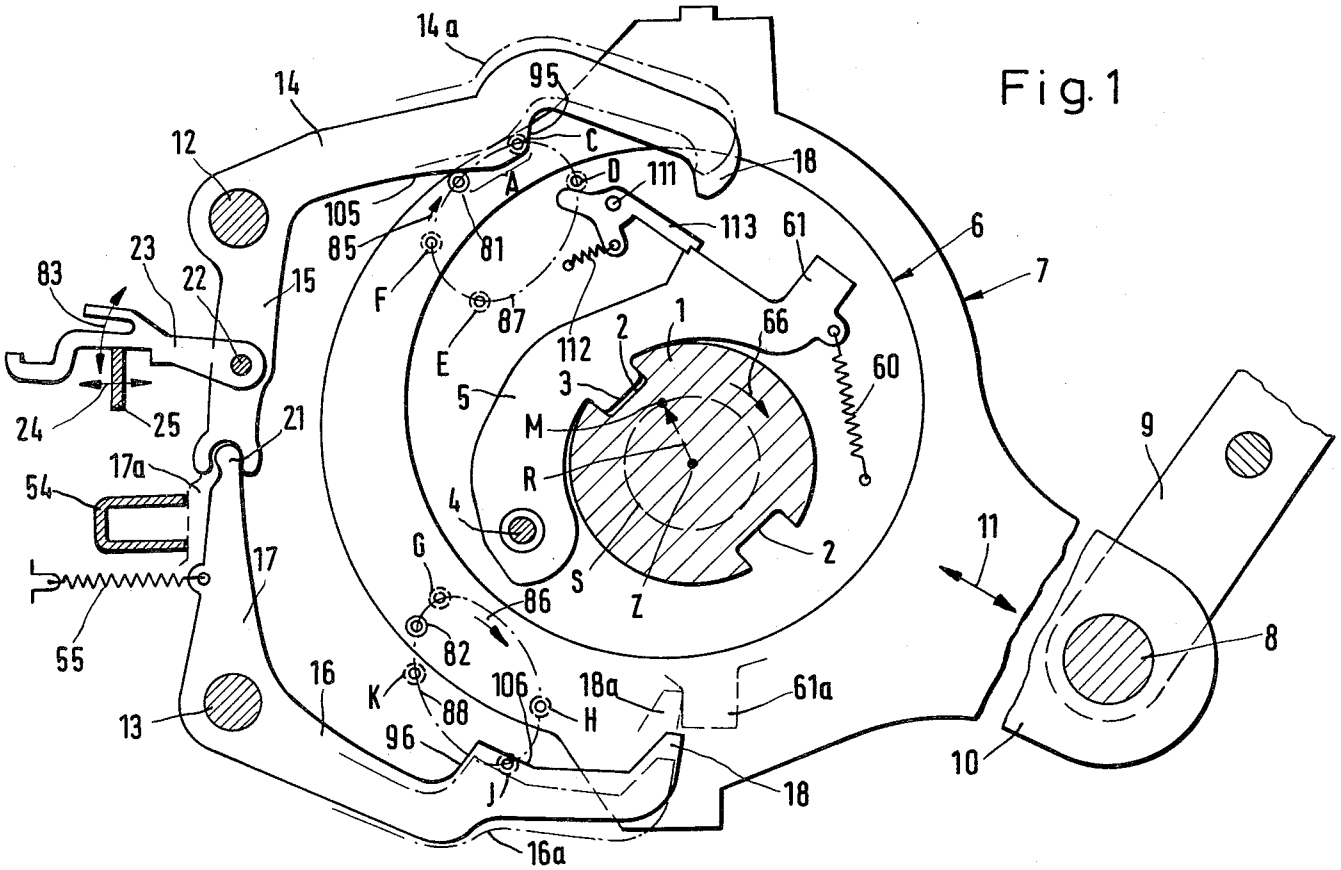

This invention relates to a clutch arrangement for controlling a heddle of a weaving machine.

As is known, various types of arrangements have been used for controlling the operation of the heddles of a weaving machine such as a power loom. For example, as described in German A.S. No. 2741 199 one known clutch arrangement utilizes an intermittently rotatable drive shaft having a slot, a pawl which can be engaged in the slot and which is disposed on an eccentric rotatably mounted on the drive shaft as well as a link for a crank rod of a heddle drive which is disposed about the eccentric. In addition, a pair of control levers which are pivotal by means of a stroke meter drive into a blocking position in the path of the pawl are used to disengage the pawl from the drive shaft. Generally, a selector mechanism, such as an electro-magnet with an armature is used to control the engagement and disengagement of the pawl.

However, in these clutch arrangements, there is no direct cooperation between the control levers and the link. Thus, if there is a defect in one or more of the selectors during the operation of the control levers, or if an operator, for example, makes some manipulations during operation in the range of action of the control levers, the control levers can be swung inward into a blocking position in any position of the eccentric and of the parts arranged thereon. As a result, certain parts of the clutch arrangement, particularly the pawl and other members cooperating therewith, are jeopardized, because one or both of the control levers can be in the path of revolution of the parts arranged on the eccentric at an improper time. The pawl or other parts can thus be damaged or broken by the swung-in control levers.

Accordingly, it is an object of the invention to provide a clutch arrangement in which the control levers are reliably maintained out of the path of a rotating eccentric.

It is another object of the invention to reduce the risk of damage to the pawls of a heddle clutch arrangement by improperly positioned control levers.

Briefly, the invention provides a clutch arrangement for controlling the heddles of a weaving machine. The clutch arrangement includes an intermittently rotatable drive shaft having at least one slot, an eccentric rotatably mounted on the shaft, a pawl mounted on the eccentric for engagement in the slot of the shaft and a link disposed about the eccentric for movement in an orbital manner about the shaft in order to impart a reciprocating movement to a connecting rod for driving a heddle with the pawl engaged in the slot. In addition, the arrangement includes at least one control lever which is moveable between a blocking position in the path of the pawl and a release position spaced from the pawl, a bar which is connected to the control lever, a stroke meter drive for moving the bar to cause the lever to move between the two positions and at least one stop element mounted on the link for engaging the control lever during rotation of the eccentric. The stop element serves to maintain the control lever in the release position during at least part of the orbital movement of the link.

Various advantages can be obtained by swinging and maintaining the control lever in the release or inoperative position during a part of the orbital movement of the eccentric. For example, in the case of a malfunction in the stroke meter drive or in a selector or in the case of a careless manipulation by an operator, the control lever can be positively maintained out of the path of the rotating parts arranged on the eccentric. In particular, the control lever can be maintained out of the path of a locking mechanism for the pawl or, when not ready for uncoupling, the pawl itself. In this way, the parts which are arranged on and which revolve with the eccentric are secured against damage. The control lever can only be swung into the blocking or operating position at that time when the pawl is to be disengaged from the shaft by the control lever.

In addition, the arrangement allows the stroke of the respective stroke meter drive for the control lever to be made relatively small. In particular, the reversing point of the stroke meter of the stroke meter drive corresponding to the swung-out position of the control lever may have a reduced deflection because the last part of the swing-out movement of the control lever can be caused by the stop element on the link.

The control lever can be made inoperative by the link itself. Thus, the control lever can be swung inwardly into the blocking position only at the desired time or time period in which the pawl moves toward the control lever and is to be swung out subsequently into the disengaged position.

Figure 2:
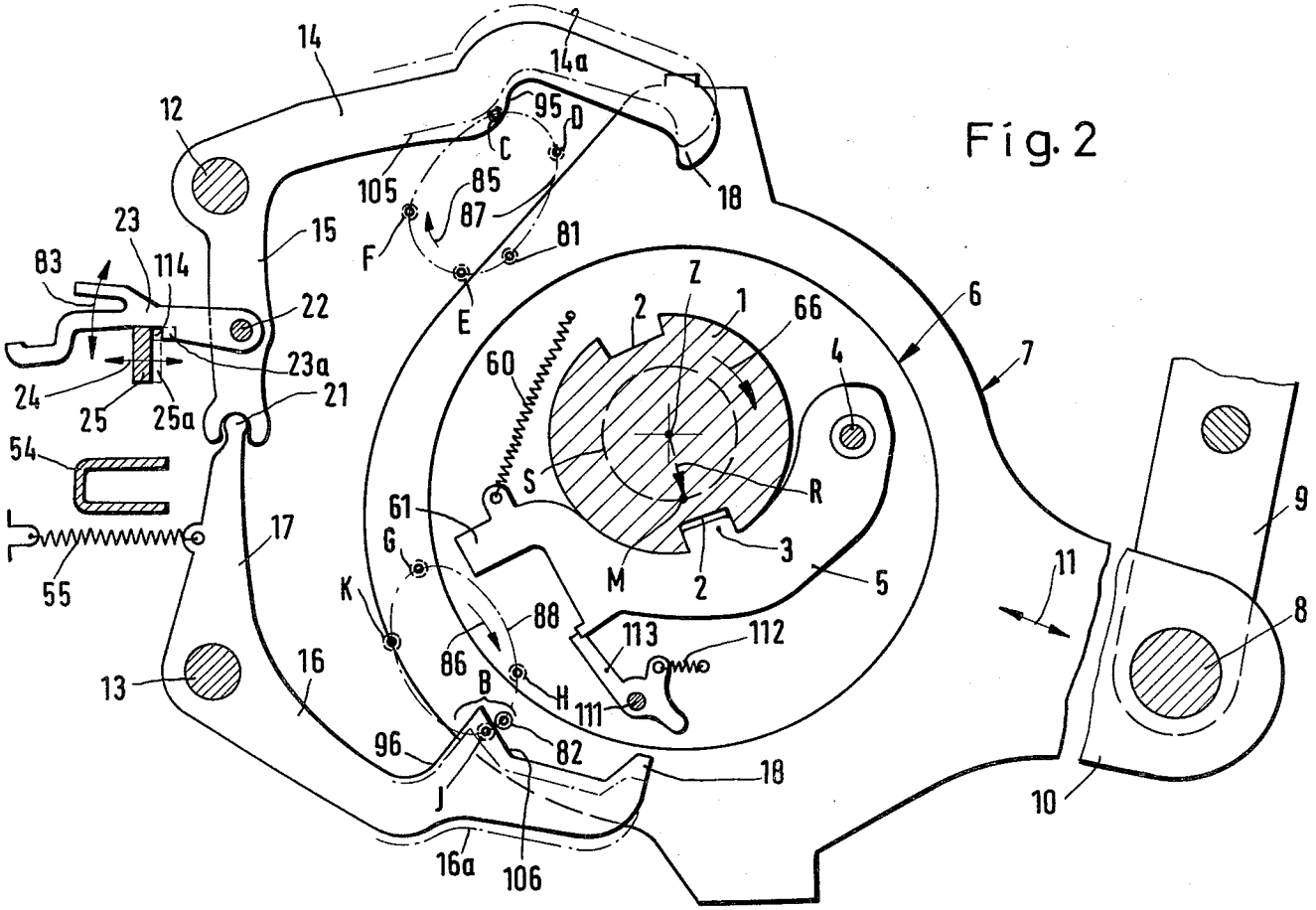

These and other objects and advantages of the invention will become more apparent from the following detailed description taken in conjunction with the accompanying drawings wherein:

FIG. 1 illustrates a view of a clutch arrangement according to the invention; and FIG. 2 illustrates a view similar to FIG. 1 of the clutch arrangement in a further position.

Referring to FIG. 1, the clutch arrangement is used for controlling a heddle (not shown) of a weaving machine, for example a power loom. As indicated, the clutch arrangement incorporates a drive shaft 1 which is intermittently rotatable in the direction indicated by the arrow 66 in increments of 180° off a main shaft (not shown) of the weaving machine. The drive shaft 1 includes a pair of diametrically opposed slots 2 for selectively receiving a nose 3 of a pawl 5 which is pivotally mounted by a suitable pivot 4 on an eccentric 6. The eccentric 6 is, in turn, rotatably mounted on the drive shaft 1 for purposes as described below. As shown, a tension spring 60 is secured to a free end 61 of the pawl 5 and to the eccentric 6 so as to bias the pawl 5 towards the drive shaft 1.

In addition, a link for a crank rod (not shown) of a heddle drive is disposed about the eccentric 6. The link 7 is articulated at a pivot point 8 to a transmission linkage 9 for movement in an orbital manner about the shaft 1 so as to impart a reciprocating movement to a connecting rod 10 of the link 7 in the direction indicated by the arrow 11 for driving the associated heddle of the loom.

Of note, the drive shaft 1 mounts a plurality, for example six to twelve of the drive parts 6, 7 for each heddle of the loom. Thus, the drive shaft 1, eccentrics 6 and links 7 form the so-called eccentric machine for the drive and control of all heddles of the loom. The heddles are thus movable according to a weaving program for the warp threads in a high or low shed position.

In order to actuate the pawl 5 during operation, the clutch arrangement employs a pair of two-armed control levers 14, 15, 16, 17 which are pivotally mounted on fixed bearing pins 12, 13 to move between a blocking position and a release position. As shown, the two control levers are connected via the arms 15, 17 in an articulated joint 21.

The clutch arrangement also has a bar 23 which is pivotally connected via a pin 22 to the arm 15 of one lever for moving the control levers between a blocking position and a release position (as shown). This bar 23 is, in turn, movable in the direction indicated by the arrow 83 by a selector (not shown) between an operative position as shown in FIG. 1 to cooperate with a stroke meter drive 25 and an inoperative position out of the influence of the stroke meter drive 25. As indicated in FIG. 1, the stroke meter drive 25 is movable in a back and forth direction as indicated by the arrow 24.

As indicated, a stationary stop 54 is located adjacent an arm 17 of one lever 16, 17 while a spring 55 biases the control lever 16, 17 towards and against the stop 54 in the blocking position of the control lever 16, 17.

Each link 7 carries a pair of stop elements 81, 82 in the form of rollers. Each roller 81, 82 is disposed so as to selectively engage a lifting flank 105, 106 on the respective control levers 14, 15; 16, 17 during the orbital movement of the link 7. The rollers 81, 82 are also positioned to cooperate with an outwardly directed bend 95, 96 on the respective control levers which adjoin the flanks 105, 106 when the control levers are to move inwardly towards a blocking position.

In addition, a locking mechanism is mounted on the eccentric 6 in order to lock the pawl 5 in coupled relation with the shaft 1. This locking mechanism includes a latch 113 which is rotatably mounted via a pin 111 on the eccentric 6 and which is biased by a tension spring 112 in a direction towards the pawl 5.

In FIGS. 1 and 2, the control levers 14–17 are each shown in a middle position (solid lines). In order to disengage the pawl 5 from the shaft 1, the control levers 14–17 are swung so that the hooks 18 take up the blocking position **18*a* indicated in broken line. Thus, when the end 61 of the pawl 5 reaches the position 61*a* (also indicated by broken lines), the pawl 5 is swung outwardly during continued rotation of the shaft 1 so that the nose 3 is pulled out of the respective slot 2. The pawl 5, eccentric 6 and link 7 as well as the respective heddle then stand still while the shaft 1** continues to rotate intermittently.

During operation, the drive shaft 1 turns in increments of 180° (double stroke method). During this time, the center M of the eccentric 6 and the link 7 moves about a circle S of radius R about the center Z of the shaft 1. At this time, the pawl 5 is engaged with the shaft 1. At the same time, the stop rollers 81, 82 rotate in respective oval paths 87, 88 in the directions indicated by the arrows 85, 86. FIGS. 1 and 2 indicate intermediate positions of the respective rollers 81, 82.

During orbital movement of the link 7, the roller 81 passes through a top position C, a far right position D, a bottom position E and a far left position F in the oval path 87. Likewise, the roller 82 passes through a top position G, a far right position H, a bottom position J and a far left position K of the oval path 88.

With the stroke meter 25 performing a full reciprocating movement, the following movements are performed. First, assuming that the pawl 5 has passed an engaged position with the end 61 under the control lever 14, 15 which is in the inoperative release position **14*a*, the pawl 5 is locked by the latch 113. As indicated in FIG. 1, at this time, the roller 81 engages the lifting flank 115 of the control lever 14, 15. Continued rotation of the shaft 1 causes the roller 81 to then swing the two control levers 14–17 outwardly into the release positions 14*a*, 16*a* indicated by dot-dash lines. This has the effect that the moving latch 113 cannot strike against the hook 18 of the control lever 14, 15. This safety action of the roller 81 exists as long as the roller 81 passes through an arc segment A of the oval path 87. This segment A, as viewed, begins partly between the positions F and A and continues to the position E. The roller 81 then arrives in the range of the bend 95 so that the control levers 14–17 can be swung inwardly under the action of the spring 55. For example, if the control levers 14–17 are swung into the blocking position, i.e. with the hooks in the position 18*a*, the pawl 5 can be disengaged. In this position, the control levers 14–17 would be swung into the blocking position via the stroke meter 25 and bar 23**.

When the control levers 14–17 are swung into the dot-dash line position by the roller 81, the hooks 18 are out of the path of the pawl 5.

Referring to FIG. 2 assuming that the control levers 14–17 are swung out again when the free end 61 of the pawl 5 approaches the hook 18 of the control lever 16, 17 (position **14*a*, 16*a*) the pawl 5 passes in a coupled position under the hook 18 of the lever 16, 17. When the stroke meter 25 has reached the right-hand reversing position 25*a*, as indicated in broken lines, the stop roller 82 strikes the lifting flank 106 of the control lever 16, 17. In this way, the stop roller 82 takes over the driving function for the levers 14–17 which was heretofore performed by the stroke meter 25. The control levers are then positioned in the dot-dash line position 14*a*, 16*a*. This prevents arm 16 and the hook 18 thereon from striking against the latch 113 during passage of the latch 113 under the hook 18**.

While the stop roller 82 passes through the arc segment B of the oval path 88, the control levers 14–17 remain in a swung-out position **14*a*, 16*a*. Subsequently, the roller 82 moves onto the bend 96 on the arm 16. The control levers 14–17 now swing inwardly under the action of the spring 55. Thus, the pawl 5 can be disengaged when the end 61 abuts the hook 18 of the control lever 14, 15, provided the control levers have not been brought by the stroke meter 25 into the inoperative release position 14*a*, 16*a***.

The stop rollers 81, 82 are positioned to strike against the lifting flanks 105–106 of the respective arms 14, 16 when the stroke meter 25 is at the reversal point **25*a*. This has a result that the bar 23 moves subsequently into the position 63*a* in which there is a clearance 114 between the bar 23 and the stroke meter 25. Thus, the rollers 81, 82 insure an overstroke of the bar 23. As a result, the stroke of the stroke meter 25** can be kept correspondingly small and the stroke meter itself is stress-relieved.

Apart from the safety function for the pawl 5 and the latch 113 arranged on the eccentric 6, the rollers 81, 82 also have the additional function of automatically taking over the last part of the swing out movement of the control levers 14–17 and the establishment of the clearance between the stroke member 25 and the bar 23. This has the effect that the central power drive of the stroke meter 25 acting on all the control levers is replaced by a drive performed by the rollers 81, 82 and acting individually on all the control levers, namely in that segment of the working cycle where the greatest driving force is required since the greatest tension of the springs 55 of all the control levers 14–17 is required in this segment.

The safety swing out of the control levers 14–17 caused by the stop rollers 81, 82 is effective only in those operating periods where the pawl 5 is coupled with the drive shaft 1 and passes under the hooks 18. That is, the swing out occurs only in those operating periods where there is actually a need for securing the pawl 5 and latch 113 against an accidental swing in of the control levers. When the pawl 5 is disengaged from the shaft 1 and the respective heedle is to remain in position, the eccentric 6, link 7 and rollers 81, 82 also stand still. At the same time, the lifting bar 23 is out of engagement with the stroke meter 25. Thus, there is no safety swing out of the control levers 14–17 as such is not necessary.

Of note, the stop rollers 81, 82 can also be used to prevent engagement of any other parts arranged on the eccentric 6. For this purpose, the position of the rollers 81, 82 on the link or the respective arc segments A, B in which the rollers 81, 82 act would be correspondingly designed. Alternatively, instead of using rollers 81, 82, the stop elements may be in the form of journals and the like.

The invention thus provides a clutch arrangement in which inadvertent movement of the control levers into the path of movement of a moving eccentric can be avoided.

The invention further provides a clutch arrangement for positively maintaining the control levers in a release position should one of the parts of the arrangement, such as the bar 23 breaks.

What is claimed is:

1. A clutch arrangement for controlling a heddle of a weaving machine, said arrangement comprising an intermittently rotatable drive shaft having at least one slot therein;

an eccentric rotatably mounted on said shaft;

a pawl mounted on said eccentric for engagement in said slot of said shaft;

a link disposed about said eccentric for movement in an orbital manner about said shaft to impart a reciprocating movement to a connecting rod for driving a heddle with said pawl engaged in said slot;

at least one control lever movable between a blocking position in the path of said pawl and a release position spaced from said pawl;

a bar connected to said control lever;

a stroke meter drive for moving said bar to cause said lever to move between said positions; and at least one stop element mounted on said link for engaging said control lever during rotation of said eccentric to maintain said control lever in said release position during at least part of said orbital movement of said link.

2. A clutch arrangement as set forth in claim 1 wherein said control lever has a lifting flank for selectively engaging said stop element during said part of said orbital movement.

3. A clutch arrangement as set forth in claim 2 wherein said control lever has an outwardly directed bend adjoining said flank to permit said control lever to move towards said blocking position.

4. A clutch arrangement as set forth in claim 1 which further comprises a pair of said control levers disposed about said shaft and a joint connecting said levers together for common pivoting action.

5. In a clutch arrangement for controlling a heddle of a weaving machine, the combination comprising an intermittently rotatable drive shaft having at least one slot therein;

an eccentric rotatably mounted on said shaft;

a pawl mounted on said eccentric for engagement in said slot of said shaft;

a link disposed about said eccentric for movement in an orbital manner about said shaft to impart a reciprocating movement to a connecting rod for driving a heddle with said pawl engaged in said slot;

at least one control lever movable between a blocking position in the path of said pawl and a release position spaced from said pawl; and at least one stop element mounted on said link for engaging said control lever during rotation of said eccentric to maintain said control lever in said release position during at least part of said orbital movement of said link.

* * * * *